US009485565B2

(12) United States Patent
Lee et al.

(10) Patent No.: US 9,485,565 B2
(45) Date of Patent: Nov. 1, 2016

(54) SOUND GENERATING APPARATUS AND ELECTRONIC APPARATUS INCLUDING THE SAME

(71) Applicant: SAMSUNG ELECTRONICS CO., LTD., Suwon-si (KR)

(72) Inventors: Gyeong-tae Lee, Seoul (KR); Jong-bae Kim, Seoul (KR); Dong-kyu Park, Hwaseong-si (KR); Jong-in Jo, Suwon-si (KR); Seung-chan Lee, Seoul (KR); Sang-min Hyun, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/310,073

(22) Filed: Jun. 20, 2014

(65) Prior Publication Data

US 2015/0010190 A1 Jan. 8, 2015

(30) Foreign Application Priority Data

Jul. 3, 2013 (KR) ..... 10-2013-0077905

(51) Int. Cl.
*H04R 1/28* (2006.01)
*H04R 1/34* (2006.01)
*H04R 1/26* (2006.01)

(52) U.S. Cl.
CPC ..... *H04R 1/2807* (2013.01); *H04R 1/345* (2013.01); *H04R 1/26* (2013.01); *H04R 1/2811* (2013.01)

(58) Field of Classification Search
CPC ..... H04R 2440/00–2440/07; H04R 1/28; H04R 1/30; H04R 1/2861; H04R 1/2865; H04R 1/02; H04R 1/025; H04R 1/026
USPC ..... 381/152, 337, 341, 160, 387–388, 395, 381/352–35, 395.3
See application file for complete search history.

(56) References Cited

U.S. PATENT DOCUMENTS

| | | | | |
|---|---|---|---|---|
| 5,225,639 | A | 7/1993 | Kobayashi et al. | |
| 5,994,634 | A * | 11/1999 | Cady | 84/421 |
| 6,035,051 | A * | 3/2000 | Sato | 381/340 |
| 6,324,052 | B1 * | 11/2001 | Azima et al. | 381/303 |
| 6,415,035 | B1 * | 7/2002 | Shin et al. | 381/388 |
| 6,533,063 | B1 | 3/2003 | Ikeuchi et al. | |
| 7,652,724 | B2 * | 1/2010 | Fukano | 381/160 |
| 8,027,500 | B2 | 9/2011 | Fincham | |

(Continued)

FOREIGN PATENT DOCUMENTS

| | | | |
|---|---|---|---|
| JP | 09-149487 | A | 6/1997 |
| JP | 3467987 | B2 | 11/2003 |

(Continued)

OTHER PUBLICATIONS

Communication, Issued by the European Patent Office, Dated Dec. 4, 2014, In counterpart European Application No. 14175521.5.

(Continued)

*Primary Examiner* — Suhan Ni
(74) *Attorney, Agent, or Firm* — Sughrue Mion, PLLC

(57) ABSTRACT

A sound generating apparatus is provided for expanding a mid-range of a slit-firing type speaker system. The sound generating apparatus includes a vibrator, a body part which encloses the vibrator, a path through which the generated sound is transmitted, and a slit formed in a length direction of the body part connected to an end portion of the path and configured to emit the sound.

19 Claims, 16 Drawing Sheets

(56) References Cited

U.S. PATENT DOCUMENTS

| | | | | |
|---|---|---|---|---|
| 8,059,843 | B2 * | 11/2011 | Hung et al. | 381/388 |
| 8,064,629 | B2 * | 11/2011 | Jiang | 381/388 |
| 8,447,052 | B2 * | 5/2013 | Lee et al. | 381/388 |
| 8,494,186 | B2 | 7/2013 | Lee et al. | |
| 8,731,219 | B2 * | 5/2014 | Weiss | 381/388 |
| 2002/0061114 | A1 | 5/2002 | Croft, III | |
| 2005/0123162 | A1 | 6/2005 | Huffman | |
| 2006/0180155 | A1 | 8/2006 | Glassenberg et al. | |
| 2009/0129623 | A1 | 5/2009 | Weckstrom et al. | |
| 2011/0188661 | A1 | 8/2011 | Ehrig et al. | |
| 2011/0188678 | A1 | 8/2011 | Lee et al. | |
| 2012/0033843 | A1 | 2/2012 | Ouweltjes et al. | |

FOREIGN PATENT DOCUMENTS

| | | | |
|---|---|---|---|
| JP | 2006-180155 | A | 7/2006 |
| JP | 4945834 | B2 | 6/2012 |
| KR | 10-2011-0090062 | A | 8/2011 |
| KR | 10-2011-0090697 | A | 8/2011 |

OTHER PUBLICATIONS

Communication, Issued by the International Searching Authority, Dated Oct. 6, 2014, In counterpart International application No. PCT/KR2014/005695.

Communication issued Aug. 7, 2015, issued by the European Patent Office in counterpart European Patent Application No. 14175521.5.

Communication from the European Patent Office issued Mar. 21, 2016 in a counterpart European Application No. 14175521.5.

* cited by examiner (a)

(b)

(a)

(b)

(a)

(b)

SOUND GENERATING APPARATUS AND ELECTRONIC APPARATUS INCLUDING THE SAME

CROSS-REFERENCE TO RELATED APPLICATION

This application claims priority from Korean Patent Application No. 10-2013-0077905, filed on Jul. 3, 2013, in the Korean Intellectual Property Office, the disclosure of which is incorporated herein by reference in its entirety.

BACKGROUND

1. Field

Apparatuses and methods consistent with exemplary embodiments relate to a loudspeaker and an acoustic filter and an electronic apparatus employing the same, and more particularly, to a sound generation apparatus having a slit-firing structure and an electronic apparatus using the same.

2. Description of the Related Art

In recent years, as electronic apparatuses are slimmed, sound apparatuses require a structure suitable for use in a slim structure. For example, to install the sound apparatuses inside a thin electronic apparatus, various sound apparatuses are manufactured, such as a down-firing type, a back-firing type, and a slit-firing type, regardless of a radiation direction. The down-firing type is a type in which a speaker is mounted on a bottom of an electronic apparatus, and sound is emitted downward and transferred toward a front side through floor reflection, an example of which is a front speaker of a digital television (TV). The back-firing type is a type in which a speaker is mounted on a back of an electronic apparatus and sound is emitted backward and transferred toward a front side using refraction, an example of which is a woofer speaker of a digital TV. The slit-firing type is a type which emits sound through a slit provided in a speaker box using Huygens diffraction principle.

The slit-firing method can maximize a main beam width of a directional beam pattern of an existing speaker to ensure that sound is not uniformly transferred according to a location by a high frequency beam formation of the existing speaker. Further, the slit-firing type can implement a speaker system having clarity higher than the existing down-firing type or the existing back-firing type by minimizing sound decay characteristic degradation of an impulse response due to an interference between a direct sound and reflected sound inside a slit through minimization of a gap of the slit. A 2-way front speaker of a digital TV is an example of the slit-firing type.

However, since there are many cases in which the slit-firing type speaker is applied to an electronic apparatus without acoustic analysis, sound quality deterioration emerges.

In the slit-firing method, a space between a speaker diaphragm and a front reflecting plate and a geometric space of a sound emission part serve as an acoustic filter, such as a Helmholtz resonator, and the Helmholtz resonator functions as a kind of a low-pass filter to cause degradation in reproduction performance of a high frequency band in a speaker.

FIG. 1 is a graph illustrating an intensity of a sound signal for frequency bands of a slit-firing type speaker.

As illustrated in FIG. 1, in the slit-firing type, because a space between a speaker diaphragm and a front reflecting plate and a geometric space of a sound emission part serve as a Helmholtz resonator, a cut-off frequency band is generated after a mid-range.

To compensate, the slit-firing type is implemented as a 2-way, that is, a mid-range speaker and a tweeter.

FIG. 2 is a view illustrating a frequency band of a 2-way speaker to solve the cut-off frequency degradation.

As illustrated in FIG. 2, a 2-way speaker system is used to represent a high frequency band represented only by a mid-range speaker. To represent the high frequency band, a tweeter is used.

The tweeter is applied as a direct-firing type or a slit-firing type. When the tweeter is implanted with the slit-firing type like a mid-range speaker, a certain buffer zone for sound absorption is provided around a tweeter dome to minimize an interference effect of a high frequency band due to reflected sound inside a slit. A size of the buffer zone for sound absorption is determined to ¼ of a wavelength of a sound wave corresponding to a crossover (X-over) band of the tweeter.

However, since a cut-off frequency of a high frequency band in a mid-range is determined by the slit-firing structure of a mid-range speaker, the slit-firing structure has a great influence on the crossover band with the tweeter. Therefore, when the slit-firing structure of the mid-range speaker is designed without acoustic analysis, a reproducing band of the mid-range speaker is narrowed, and thus the tweeter has to reproduce a frequency of below a resonance point (fo) to reproduce a crossover band. Therefore, there is a need for a fundamental method for expanding a mid-range of a slit-firing type speaker system.

An existing slit-firing type speaker system has to implement a constant ground plane radiation condition in a bottom front of a slit radiation part to ensure a stable acoustic characteristic regardless of an installation location. Otherwise, various problems occur according to a floor reflection condition.

FIGS. 3(*a*)-(*b*) are views illustrating an intensity of a sound signal for frequency bands according to an installation location of a slit-firing type speaker.

In FIG. 3 (*a*), a slit-firing type speaker 30 lies on a left point of a table 31. When a sound radiating direction of the slit-firing type speaker 30 is a right direction, an emitted sound is affected by a tabletop 32 of the table 31.

It can be seen from a graph illustrated in FIG. 3 (*b*), when the slit-firing type speaker 30 is located on an inner portion of the table 31, an intensity of the sound signal is kept uniform. When the slit-firing type speaker 30 is located on an end of the table 31, an intensity of a sound signal is weakened in a partial section.

In the slit-firing type speaker, deformation in frequency flatness and a directional beam pattern, and dip/peak in a frequency response due to an interference according to refraction and scattering may occur according to a floor reflection condition. Therefore, there is a need for a speaker system having a ground plane radiation condition capable of maximizing an intensity of a sound signal.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments may fundamentally improve degradation in a cut-off frequency of a high frequency band in a mid-range speaker due to a slit inner structure of a slit-firing type.

Other exemplary embodiments are to provide a slit-firing type speaker system having a ground plane radiation condition capable of ensuring stable acoustic characteristics regardless of an installation location.

According to an aspect of an exemplary embodiment, there is provided a sound generating apparatus. The sound generating apparatus may include: a vibrator configured to generate sound by making a diaphragm vibrate through reciprocal motion of a voice coil; and a body part in which the vibrator is disposed, the body part comprising a path formed therein through which the sound generated by the vibrator passes and a slit connected to an end portion of the path, the slit configured to emit the sound generated by the vibrator, and the slit may be formed in a length direction of the body part.

The vibrator may include a mid-range sound generator and a high-range sound generator. The mid-range sound generator may include at least one of a rectangular speaker or an elliptical speaker.

The high-range sound generator may be a tweeter.

The body part may be a rectangular or elliptical shape.

The body part may be formed so that an area of the slit is maximized, and a volume of the path is minimized under a condition in which an intensity of the sound generated in the vibrator is constant.

The volume of the path and the area of the slit may be modeled based on a Helmholtz resonator.

The vibrator may be formed in one side of the path and an end portion of the vibrator may be formed to protrude outward from the path.

The path may be formed to have a predetermined slope with respect to the body part.

The body part may include a surface reflecting plate configured to reflect sound emitted through the slit and formed to extend from a bottom of the slit.

The vibrator may be disposed such that an orientation of the vibrator is divergent from an orientation of the body part.

According to aspects of the exemplary embodiments, a sound generating apparatus having a ground plane radiation condition is provided, capable of fundamentally improving degradation of a cut-off frequency of a high frequency band in a mid-range speaker due to a slit inner structure of a slit-firing type, and ensuring stable acoustic characteristics regardless of an installation location, and an electronic apparatus using the same.

Additional aspects of the exemplary embodiments will be set forth in the detailed description, will be obvious from the detailed description, or may be learned by practicing the exemplary embodiments.

BRIEF DESCRIPTION OF THE DRAWING FIGURES

The above and other aspects will be more apparent by describing in detail exemplary embodiments, with reference to the accompanying drawings, in which.

Figure 1:
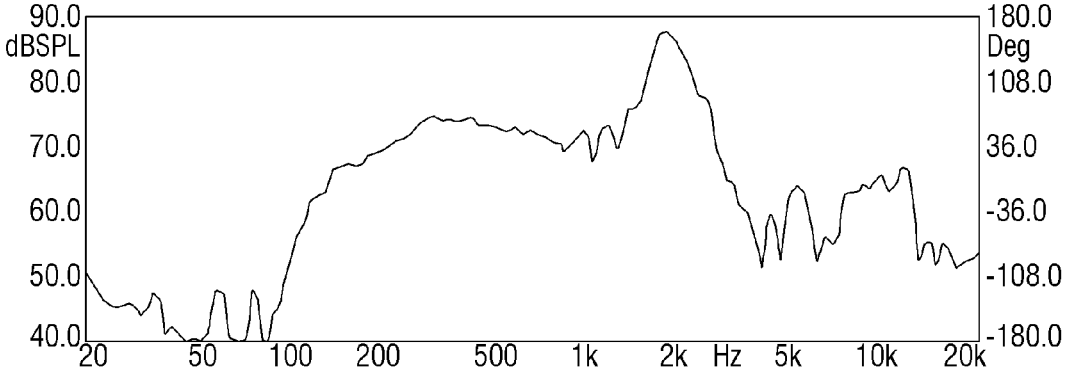
FIG. 1 (RELATED ART)
FIG. 1 is a graph illustrating an intensity of a sound signal for frequency bands in a slit-firing type speaker.
Figure 2:
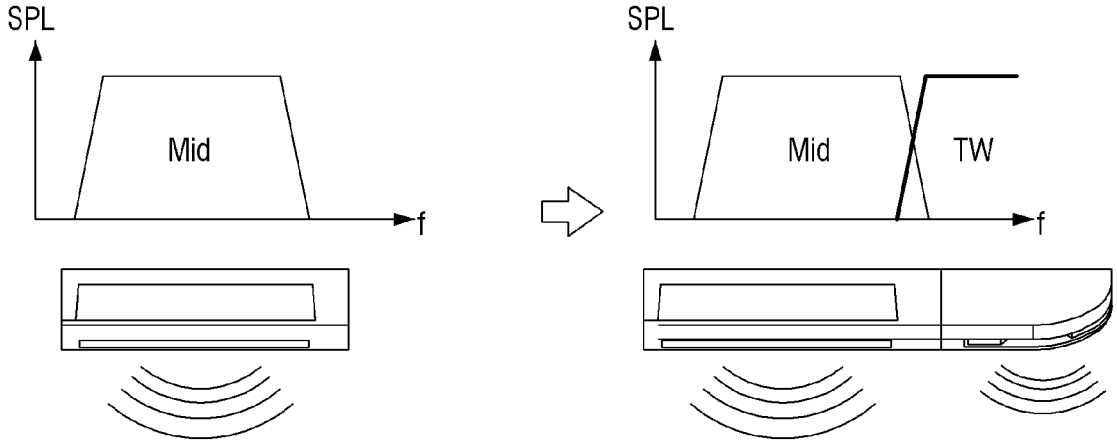
FIG. 2 (RELATED ART)
FIG. 2 is a view illustrating a frequency band of a 2-way speaker for solving a cut-off frequency degradation.
Figure 3:
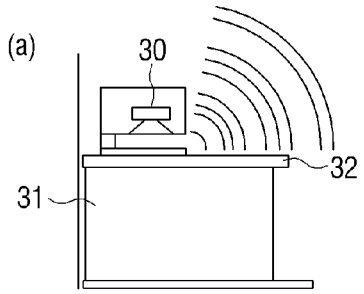
FIG. 3 (RELATED ART)
Figure 3:
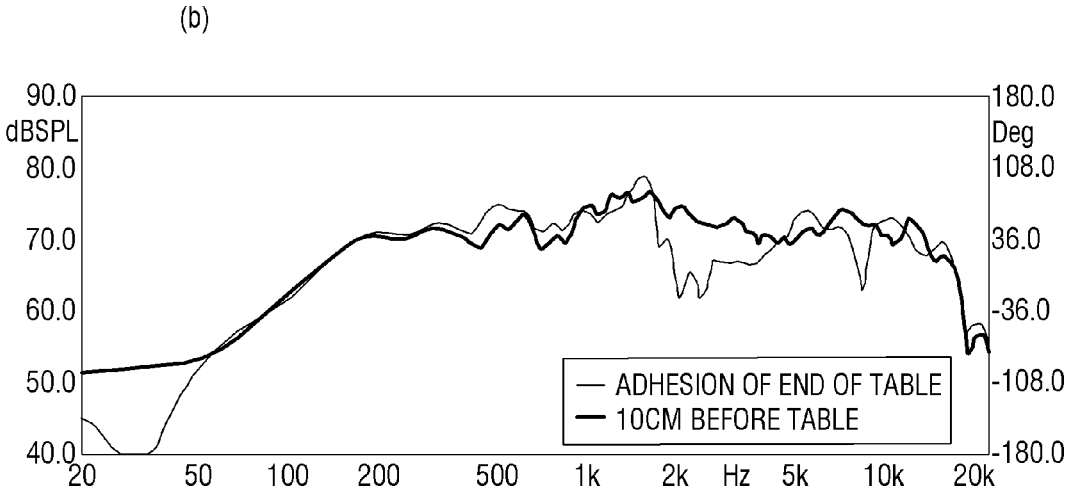
FIG. 3 (RELATED ART)
Figure 4:
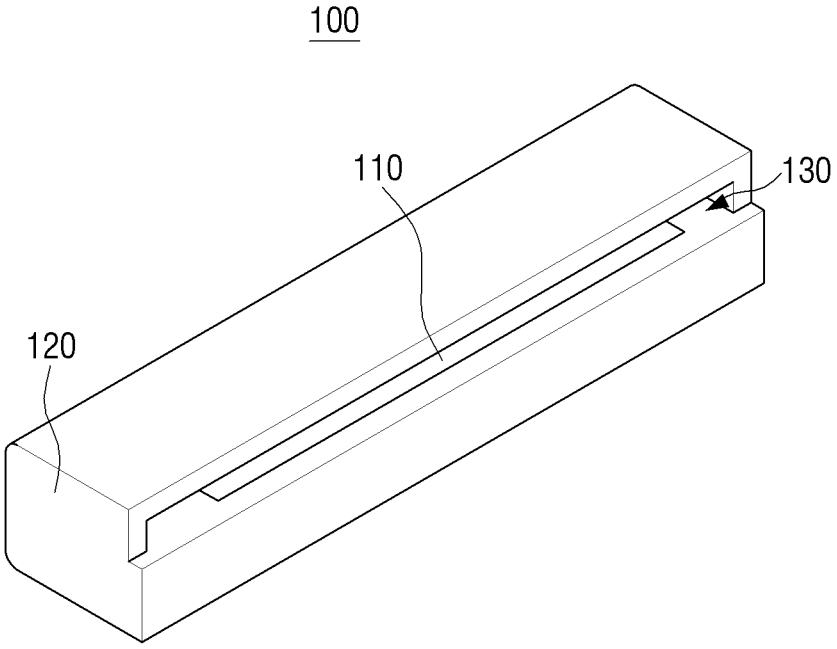
Figure 5:
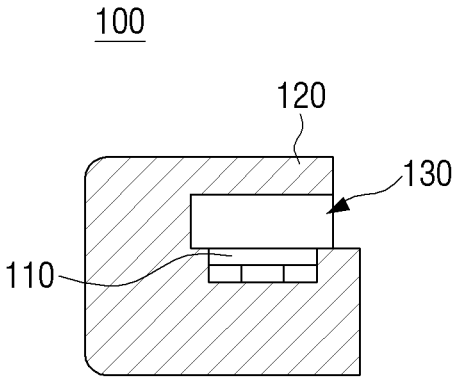
Figure 6:
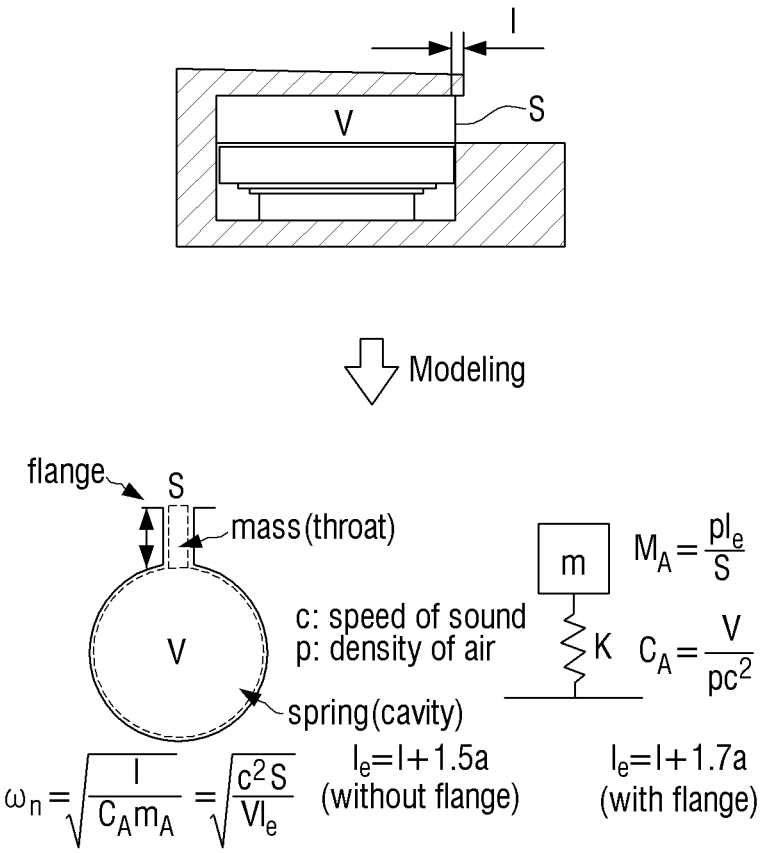
Figure 7:
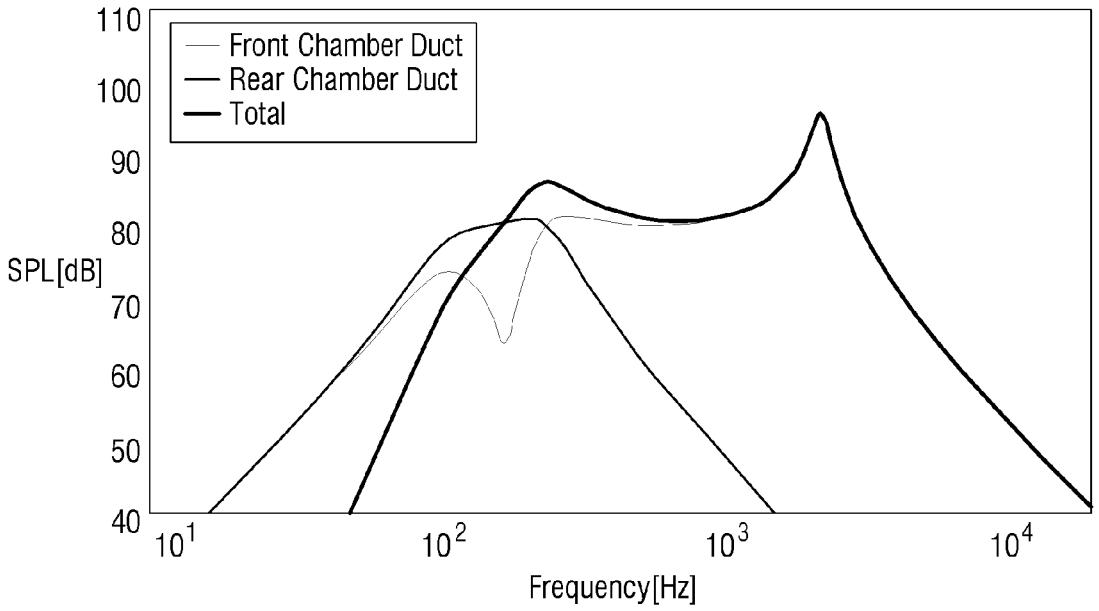
Figure 7:
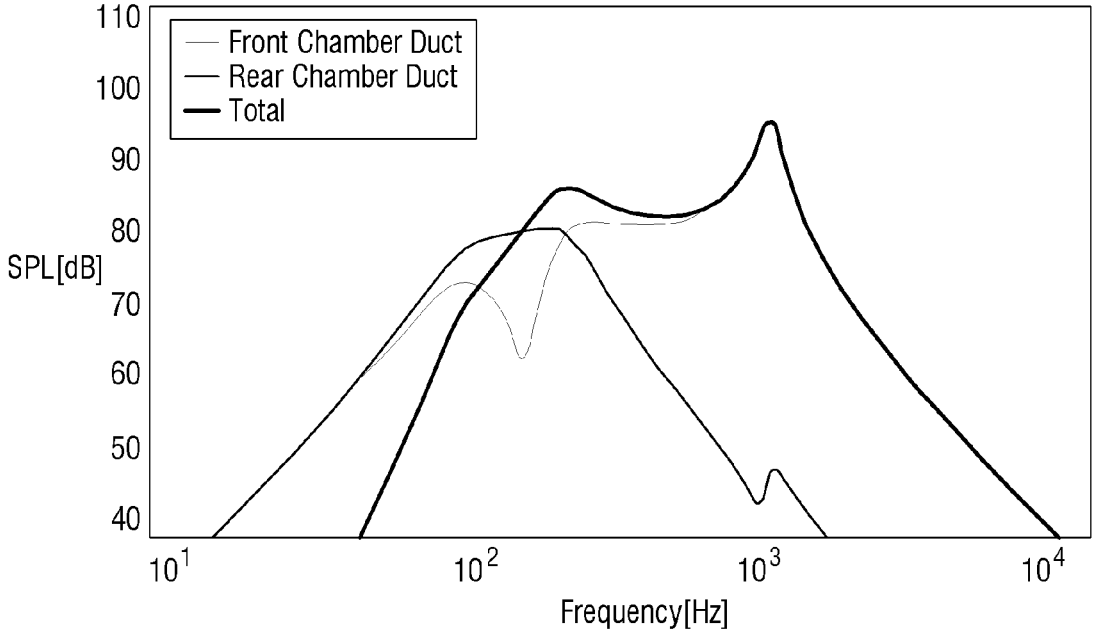
Figure 8:
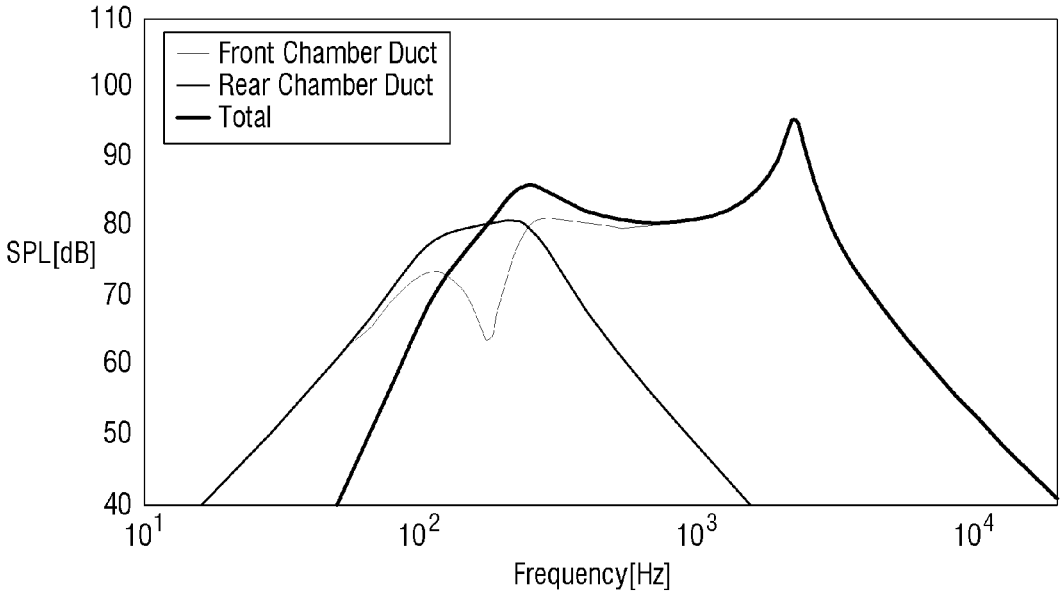
Figure 8:
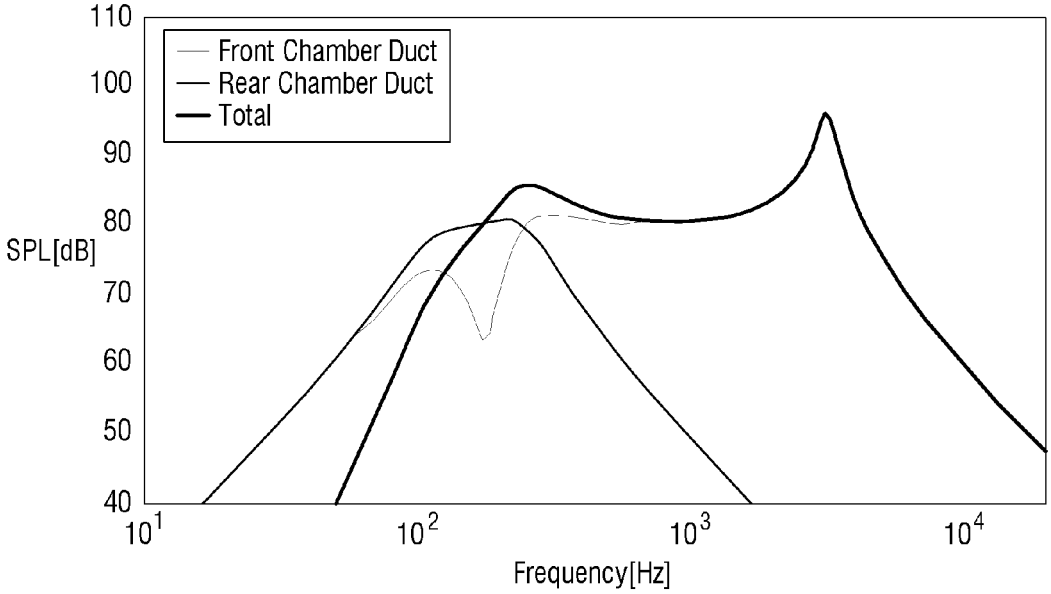
Figure 9:
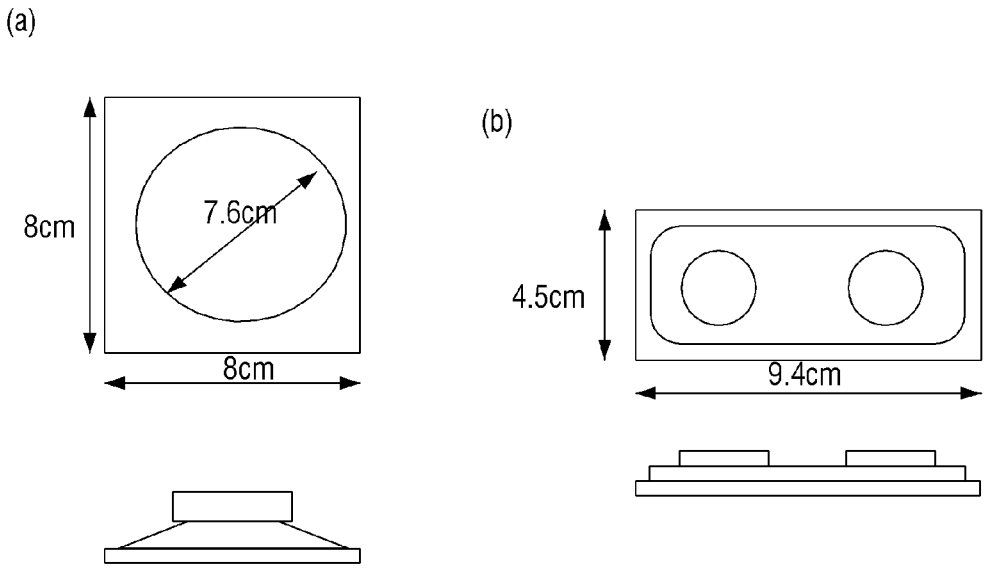
Figure 10:
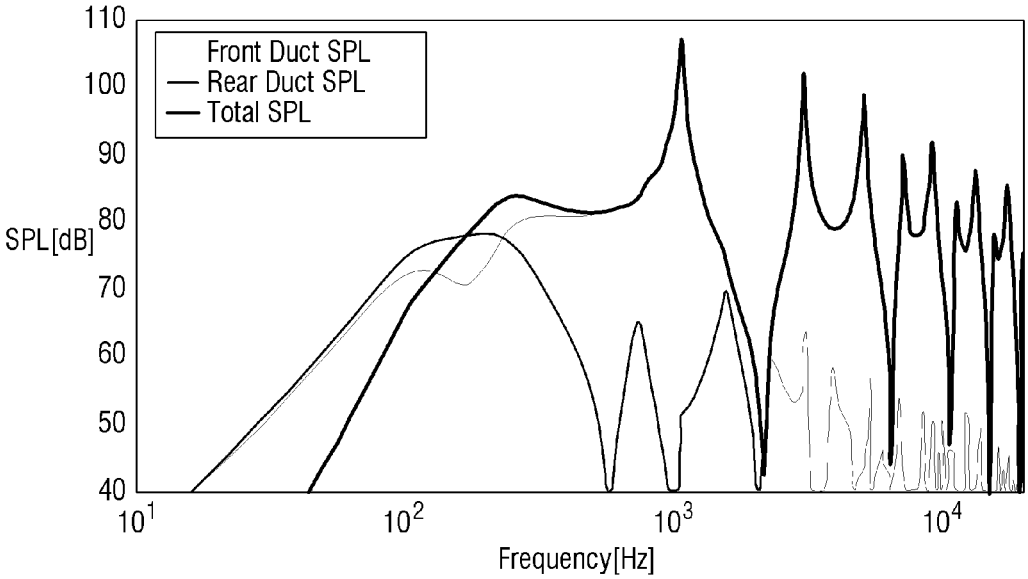
Figure 10:
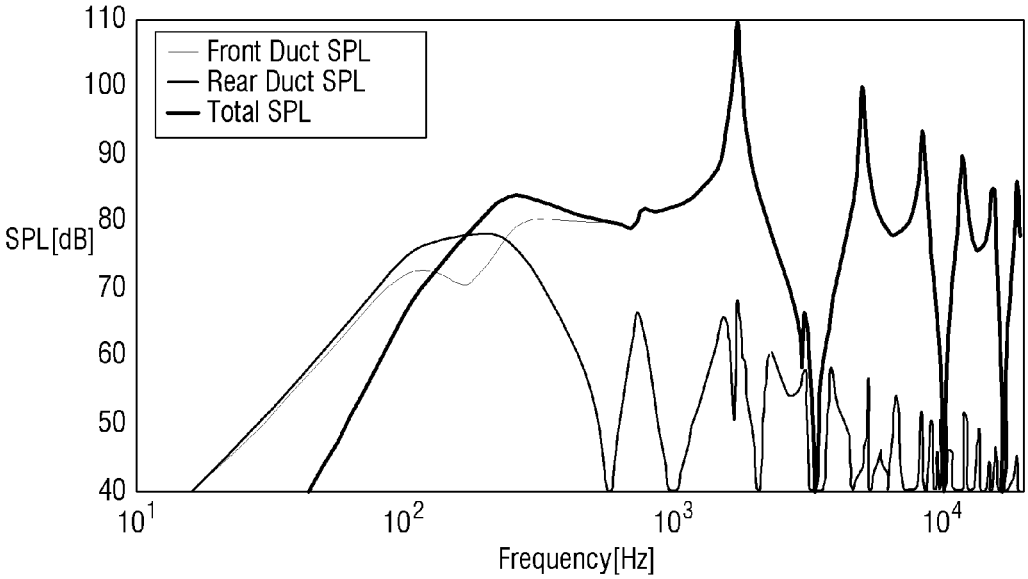
Figure 11:
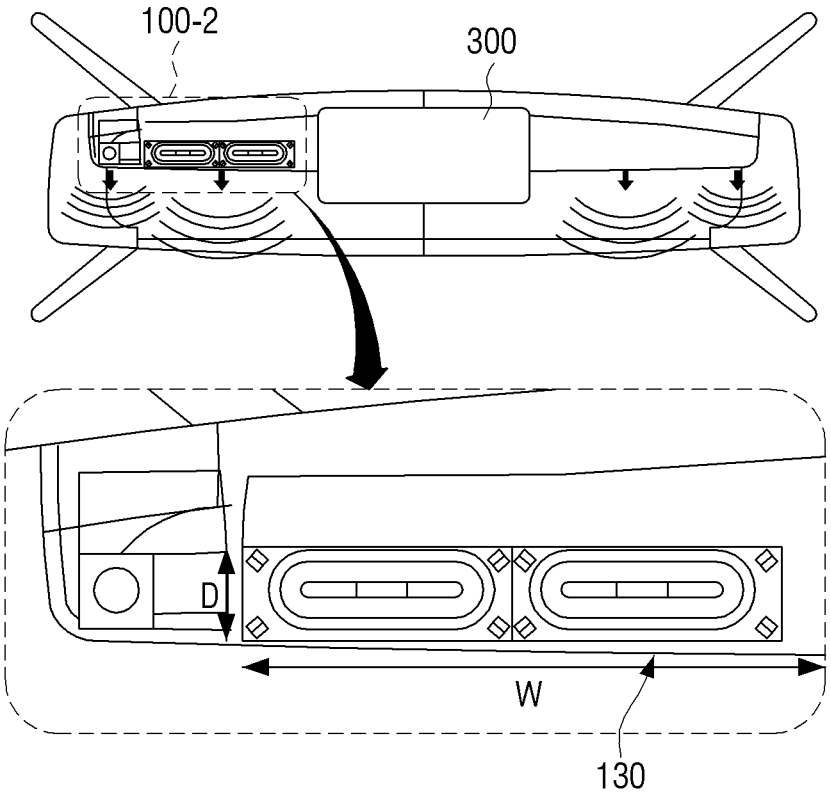
Figure 12:
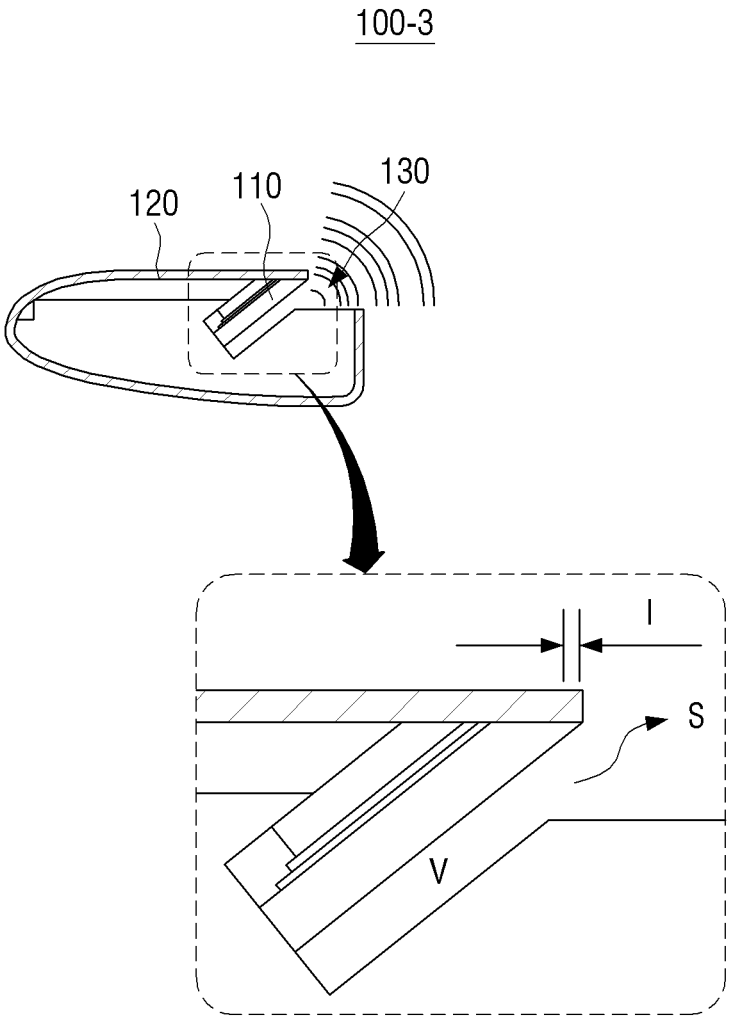
Figure 13:
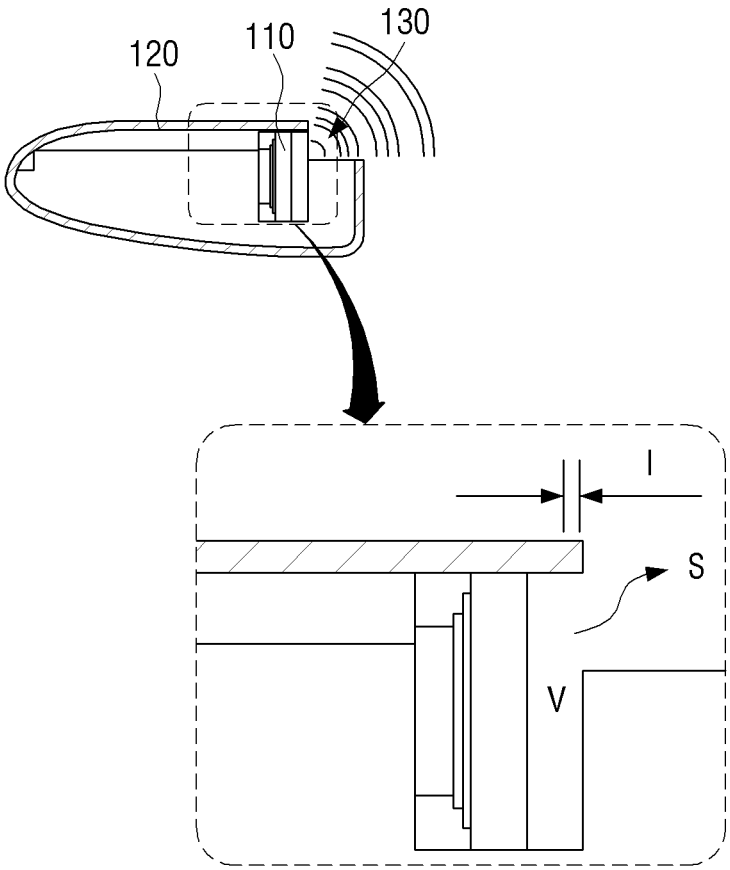
Figure 14:
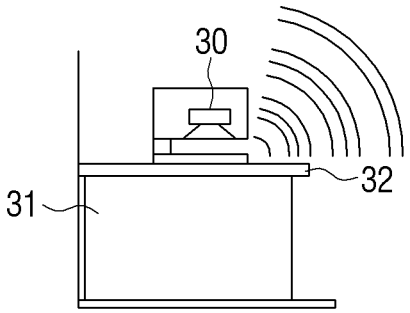
FIG. 14 (RELATED ART)
Figure 15:
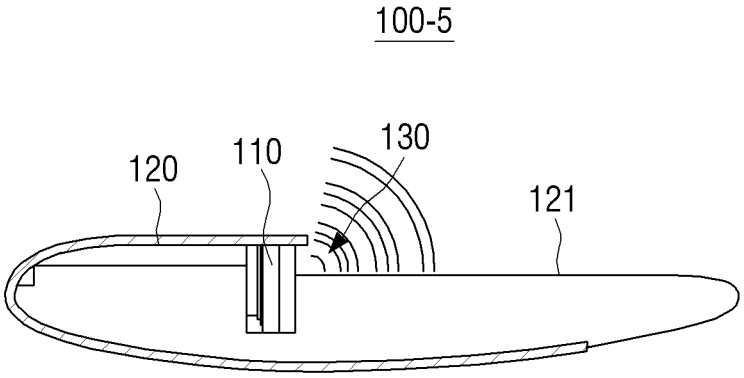
Figure 16:
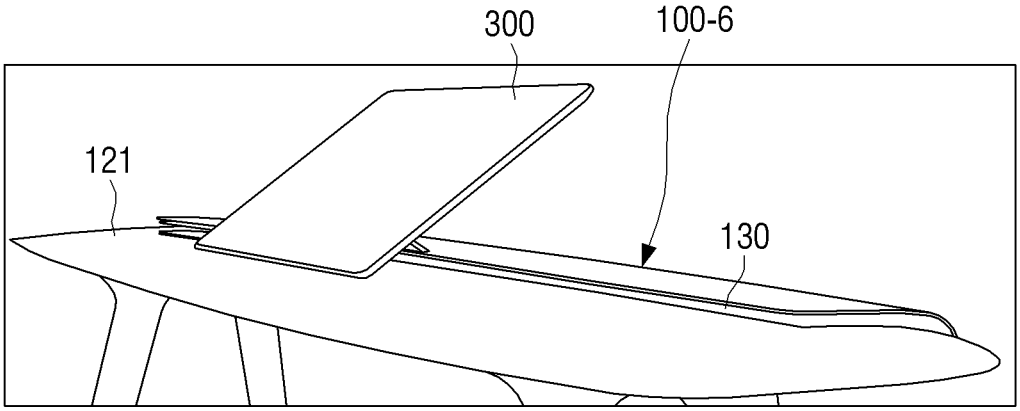

FIGS. 3(*a*)-(*b*) are views illustrating an intensity of a sound signal for frequency bands according to an installation location of a slit-firing type speaker;

FIG. 4 is a perspective view illustrating a sound generating apparatus according to an exemplary embodiment;

FIG. 5 is a lateral cross-sectional view of the sound generating apparatus of FIG. 4;

FIG. 6 is a view illustrating a method of modeling a sound generating apparatus using a Helmholtz resonator;

FIGS. 7(*a*)-(*b*) are views illustrating simulation results for a frequency response in a slit-firing type mid-range speaker according to change in an internal volume;

FIGS. 8(*a*)-(*b*) are views illustrating simulation results for a frequency response in a slit-firing type mid-range speaker according to change in an opening area;

FIGS. 9(*a*)-(*b*) are views illustrating an existing square slit-firing type sound generating apparatus mounted with a circular speaker unit and an exemplary embodiment of a rectangular slit-firing type sound generating apparatus mounted with a rectangular speaker unit;

FIGS. 10(*a*)-(*b*) are views illustrating simulation results for a frequency response in the sound generating apparatus of FIG. 8;

FIG. 11 is a view illustrating a structure of a sound generating apparatus in which a plurality of vibrators are disposed in parallel according to an exemplary embodiment;

FIG. 12 is a lateral cross-sectional view of a sound generating apparatus according to another exemplary embodiment, and an enlarged view illustrating a moving path of sound;

FIG. 13 is a lateral cross-sectional view of a sound generating apparatus according to another exemplary embodiment, and an enlarged view illustrating a moving path of sound;

FIG. 14 is a view illustrating a floor condition in the related art;

FIG. 15 is a lateral cross-sectional view of a sound generating apparatus according to another exemplary embodiment; and FIG. 16 is a view illustrating an implementation example of a sound generating apparatus according to an exemplary embodiment.

DETAILED DESCRIPTION OF THE EXEMPLARY EMBODIMENTS

Hereinafter, exemplary embodiments will be described in more detail with reference to the accompanying drawings.

In the following description, the same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

FIG. 4 is a perspective view illustrating a sound generating apparatus according to an exemplary embodiment, and FIG. 5 is a lateral cross-sectional view of the sound generating apparatus of FIG. 4.

Referring to FIGS. 4 and 5, a sound generating apparatus 100 according to an exemplary embodiment includes a vibrator 110 and a body part 120.

The vibrator 110 is configured to generate sound by making a diaphragm vibrate by a reciprocal motion of a voice coil (not shown). The vibrator 110 includes a permanent magnet (not shown), a bobbin located around the permanent magnet (a voice coil is wired therein), a damper (not shown) configured to support the bobbin to be reciprocated, and a diaphragm (not shown) configured to make motion, according to motion of the bobbin, form a wave of condensation of air particles, and generate sound. When current flows in the voice coil, a magnetic field around the permanent magnet is changed, the bobbin is reciprocated, and thus the diaphragm connected to the bobbin vibrates to emit sound. The vibrator 110 may include a configuration of a general speaker, but detailed description thereof will be omitted.

The vibrator 110 may include a 2-way speaker, that is, a mid-range speaker and a tweeter. The mid-range speaker may use a bar type speaker unit having a rectangular shape or an elliptical shape to ensure a maximum opening surface to an area of the diaphragm. The tweeter may use any type speaker unit when the tweeter can be mounted on an inner space of a slit. The tweeter may be mounted under a flush mounted condition that a frame of the tweeter is installed to have the same height as a wall surface of the peripheral body part 120, and there is no obstacle around the tweeter.

The body part 120 includes an enclosure configured to form a body of the sound generating apparatus 100, and enclose the vibrator 110. A primary objective of the enclosure is to prevent sound cancelation in a low frequency band having wide directivity by baffling dipole sound of a sound source type in which sounds having 180 degrees out-of-phase are emitted back and forth. However, it is difficult to physically implement infinite baffle, and thus the enclosure is implemented in a type enclosing a back and both lateral surfaces of the vibrator 110. An enclosure fully enclosing the vibrator is referred to as a sealed type. Since the sealed type enclosure requires a large volume to ensure a low frequency band, various types of enclosures may be used to further ensure a wide low frequency band under the same condition. A vented enclosure of a bass reflex type is a typical example.

The body part 120 includes a path through which the generated sound moves. In other words, a slit space is formed between the vibrator 110 and an opening 130 of the body part 120. The slit space is configured of a space between the speaker diaphragm and a front reflecting plate and a lateral reflector (not shown). The slit space on an acoustic structure externally expands directivity and internally serves as an acoustic filter, such as a Helmholtz resonator. A slit space of a mid-range speaker has to move a Helmholtz resonance frequency to a frequency as high as possible to ensure a reproducing band of the mid-range speaker through crossover with the tweeter. To this end, the mid-range speaker is disposed based on Helmholtz resonance principle.

A slit space of the tweeter employs a constant buffer zone for sound absorption around a tweeter dome to minimize an interference effect of a high-frequency band due to reflected sound inside the slit. A size of the buffer zone for sound absorption is ¼ of a wavelength of a sound wave corresponding to a crossover band of the tweeter.

The inside of the slit space in the slit-firing type speaker system may be modeled using a Helmholtz resonator.

FIG. 6 is a view illustrating a method of modeling a sound generating apparatus using a Helmholtz resonator.

Because the Helmholtz resonator amplifies sound corresponding to a resonance frequency and blocks sound of above the resonance frequency, the Helmholtz resonator serves as a low-pass filter. Therefore, in the slit space of the mid-range speaker, a reproducing band of the speaker unit is up to the Helmholtz resonance frequency, and thus it is necessary to move the resonance frequency to a frequency as high as possible for crossover. When the mid-range speaker cannot ensure a sufficiently high frequency band, the tweeter reproduces a frequency of below a frequency point (fo) for crossover, thereby deteriorating reliability.

When the slit radiating space is modeled using the Helmholtz resonator, as illustrated in FIG. 6, an internal volume V is a slit inner space formed between the diaphragm of the speaker unit and the front reflecting plate, and an opening area S is a silt area of a slit radiating part. A neck length I is a length between the internal volume and an opening. As illustrated in FIG. 6, it is expected that frequency wn is proportional to the opening area S and inversely proportional to the internal volume V and the neck length I. The sound generating apparatus 100 has to be designed by considering the characteristics.

A simulation was performed using Helmholtz resonance principle to ensure a crossover band of a slit-firing type mid-range speaker as follows.

FIGS. 7(*a*)-(*b*) are views illustrating simulation results for a frequency response of a slit-firing type mid-range speaker according to change in an internal volume V.

In FIG. 7(*a*), an experiment in a state in which the internal volume V is 5 cc was performed, and in FIG. 7(*b*), an experiment in a state in which the internal volume V is 20 cc was performed. It can be seen from the experiment results that as the internal volume V is small, a frequency crossover band moves to the right, as illustrated in FIGS. 7(*a*) and 7(*b*). That is, it can be seen, when the internal volume V is small under the same condition, a resonance frequency for crossover moves to a high frequency band.

FIGS. 8(*a*)-(*b*) are views illustrating simulation results for a frequency response of a slit-firing type mid-range speaker according to change in an opening area S.

In FIG. 8(*a*), an experiment was performed, and in FIG. 8(*b*), an experiment was performed, in which the width of the opening surface is four times larger than the width of the opening surface in FIG. 8(*a*). It can be seen from the experiment results that as the opening area S is large, a frequency crossover band moves to the right, as illustrated in FIGS. 8(*a*) and 8(*b*). That is, it can be seen that, when the opening area S is large under the same condition, a resonance frequency for crossover further moves to a high frequency band.

It can be seen from the simulation results that as the internal volume V is small, and the opening area S is large, it is advantageous to ensure the crossover band of the mid-range speaker. Therefore, it can be seen that the internal volume V has to be reduced or the opening area S has to be increased to ensure the crossover band by moving the resonance frequency of a slit space in the mid-range speaker to a high frequency, as shown in the Helmholtz equation of FIG. 6.

To maximize the opening area S on the basis of the same area of the diaphragm while keeping the internal volume small, the slit inner space and the speaker unit of the mid-range speaker should be the shape of a circle or a rectangle. Because the internal volume V is equal to the product of the opening area S and a height H of the slit space, a distance D from a slit opening to an opposite surface has to be minimized to maximize the opening area S while keeping the internal volume V small. The structure has an advantage to move peak/dip generated by a sound mode of an opening direction to above a crossover band.

FIGS. 9(*a*)-(*b*) are views illustrating an existing square slit-firing type sound generating apparatus mounted with a circular speaker unit and an exemplary embodiment of a rectangular slit-firing type sound generating apparatus mounted with a rectangular speaker unit. FIGS. 10(*a*)-(*b*) are views illustrating simulation results for frequency response in the sound generating apparatus of FIG. 8, and FIG. 11 is a view illustrating a structure of a sound generating apparatus 100-2 in which a plurality of vibrators are disposed in parallel according to an exemplary embodiment.

It can be seen from the simulation results that, as compared to a threshold frequency of a high frequency band shown to be about 1.5 kHz in the square slit-firing type sound generating apparatus (see FIG. 10A), a threshold frequency of a high frequency band is shown to about 2.5 kHz in the rectangular slit-firing type sound generating apparatus (see FIG. 10B), and thus a reproducing band of about 1 kHz is ensured, as compared to the existing sound generating apparatus. Further, as expected, it can be seen that high frequency peak/dip moves to above the crossover band with the tweeter. Therefore, as compared to the existing square slit-firing type sound generating apparatus, the rectangular slit-firing type sound generating apparatus is advantageous to ensure a high frequency reproducing band, and is further advantageous to ensure reliability by reducing burden of the tweeter.

As described above, the body part 120 includes a slit (that is, the opening 130) connected to an end portion of the path and configured to emit the moving sound. According to the above-described analysis, the slit 130 is formed in a length direction of the body part 120, as illustrated in FIG. 4. Further, as described above, the vibrator 110 includes a mid-range speaker and a high-range speaker (tweeter), and the mid-range speaker may have a rectangular shape or an elliptical shape. An overall shape of the sound generating apparatus 100 may have a rectangular shape or an elliptical shape, and the slit 130 may be formed in a length direction of the sound generating apparatus 100.

It is advantageous that the opening 130 is formed along a long side of a rectangular speaker (or a major axis of an elliptical speaker) in the rectangular or elliptical slit-firing type speaker. That is, when the major axis/minor axis type mid-range speaker is applied, to ensure a wide reproducing band in the same area of the diaphragm, a slit opening W has to be increased so that the distance D from the slit opening to the opposite surface is minimized. However, as the diaphragm is formed in an elongated shape, because structural rigidity is weakened, and thus a vibration mode band of the diaphragm is lowered to a low frequency, a reproducing band is affected. Therefore, to minimize the effect, as illustrated in FIG. 11, a plurality of major axis/minor axis type mid-range speakers are disposed in parallel to form the slit opening W to be lengthened.

A method for further reducing the internal volume V while further maximizing the opening area S in the Helmholtz resonator modeling may be considered other than the above-described exemplary embodiment. Hereinafter, the other exemplary embodiments will be described.

FIG. 12 is a lateral cross-sectional view of a sound generating apparatus 100-3 according to another exemplary embodiment, and an enlarged view illustrating a moving path of sound.

Referring to FIG. 12, in the sound generating apparatus 100-3 according to the exemplary embodiment, the vibrator 110 may be formed in one side of the path and an end portion of the vibrator may be formed to protrude outward from the path. At this time, because a portion of the vibrator 110 is exposed in a front slit 130 and a portion of a reflection surface of a slit front is used as a slit structure, a high frequency reproducing band can be ensured to the maximum by minimizing the internal volume V and maximizing the opening area S. Because the distance from the slit opening to the opposite surface is minimized, peak/dip generated by a sound mode of an opening direction is moved to above a crossover band.

Further, there is a method of disposing the vibrator 110 not to be parallel to (i.e., divergent from) a peripheral enclosure, as illustrated in FIG. 12. That is, a path may be formed to have a predetermined slope with the body part 120. At this time, an inner product between a direction vector of a speaker unit of the vibrator 110 and a direction vector of an enclosure of a slit from is not 1.

FIG. 13 is a lateral cross-sectional view of a sound generating apparatus 100-4 according to another exemplary embodiment, and an enlarged view illustrating a moving path of sound.

Referring to FIG. 13, in the sound generating apparatus 100-4 according to the exemplary embodiment, a vibrator 110 may be formed in a front of the path and disposed at substantially right angle with respect to a peripheral enclosure. At this time, an inner product between a direction vector of the vibrator 110 and a direction vector of an enclosure of a slit front is not 1.

At this time, since a portion of the vibrator is exposed in a front slit 130 and a portion of a reflection surface of a slit front is used as a slit structure, a high frequency reproducing band can be maximized by minimizing an internal volume V and maximizing an opening area S. Because the distance from the slit opening to the opposite surface is minimized, peak/dip generated by a sound mode of an opening direction can move to above a crossover band.

To improve a sound output of a listening position of a listener to the same input in an existing slit-firing method, ground plane radiation is implemented using a floor reflection of the slit front. The ground plane radiation method is an effective radiation method in which direct sound emitted in the slit and reflected sound reflected from a floor of the slit front overlap to increase sound pressure by about +3 dB to +6 dB to the same input, and a direction of a main beam of a directional beam pattern is directed to a top of the slit in which the listener is located. However, when the ground plane radiation condition is implemented using an external floor plane, like an existing method, a frequency response and an radiation pattern may be changed by the installed floor condition.

FIG. 14 is a view illustrating a floor condition in the related art.

For example, when an installed floor is a table, in an existing speaker system, a length of a floor in a slit front is changed according to an installation location, and a band of an interference wave due to refraction/scattering generated in table corners is changed according to the length. Because the interference wave serves as a middle/high frequency com filter or affects the directional beam pattern, a band affected by an interference wave is changed according to the installation location of the speaker system. Therefore, the existing slit-firing type speaker system affects an overall frequency response and a radiation pattern according to the installation location thereof.

FIG. 15 is a lateral cross-sectional view illustrating the sound generating apparatus 100-5 according to another exemplary embodiment.

The sound generating apparatus 100-5 according to the exemplary embodiment implements a ground plane radiation with an integrated floor reflection plane using a wall surface of a speaker enclosure to remove an effect according to an installation condition.

As illustrated in FIG. 15, in a body part 120 in the sound generating apparatus 100-5 according to the exemplary embodiment, the sound generating apparatus 100-5 includes a surface reflecting plate 121 configured to reflect sound emitted through a slit 130 and formed to extend from a bottom of the slit 130 toward a front of the slit. The surface reflecting plate 121 may implement a ground plane radiation condition to ensure a stable directional beam pattern regardless of an installation location of the slit-firing type speaker system. A floor reflection-integrated slit-firing type speaker system implements stable ground plane radiation by designing a length and corner of a slit front enclosure to minimize an interference effect without a change in a frequency response and radiation pattern according to the installation location of the speaker system.

FIG. 16 is a view illustrating an implementation example of a sound generating apparatus 100-6 according to an exemplary embodiment.

In FIG. 16, a display apparatus 300 transmits a sound signal to the sound generating apparatus 100-6. The sound generating apparatus 100-6 generates sound using the received sound signal and emits the generated sound. As illustrated in FIG. 16, the sound generating apparatus 100-6 emits the generated sound through a slit 130 formed in a length direction, and reflects the emitted sound through the surface reflection plate 121.

The sound generating apparatuses according to the above-described exemplary embodiments can minimize high frequency loss in a mid-range speaker through a slit inner structure and the rectangular (or elliptical) vibrator 110, and a nonparallel (i.e., divergent) arrangement of the vibrator 110 and a peripheral enclosure. Thus, the sound generating apparatuses improve reliability of a tweeter to ensure stable mid-range/high-range sound quality as compared to an existing slit-firing type.

The sound generating apparatuses can minimize high frequency loss in a mid-range speaker through an arrangement of the vibrator 110 and the peripheral enclosure at a substantially right angle. Thus, the sound generating apparatuses improve reliability of a tweeter to ensure stable mid-range/high-range sound quality, as compared to an existing slit-firing type.

Further, the sound generating apparatuses can implement stable ground plane radiation without change in a frequency response and a radiation pattern according to an installation location of a slit-firing type speaker system through implementation of ground plane radiation using an enclosure.

The foregoing exemplary embodiments and advantages are merely exemplary and are not to be construed as limiting the present inventive concept. The exemplary embodiments can be readily applied to other types of devices. Also, the description of the exemplary embodiments is intended to be illustrative, and not to limit the scope of the claims, and many alternatives, modifications, and variations will be apparent to those skilled in the art.

What is claimed is:

1. A sound generating apparatus, comprising:

a vibrator configured to generate sound by making a diaphragm vibrate through reciprocal motion of a voice coil; and a body part, the body part comprising:

a cavity in which the vibrator is disposed;

a path formed in the cavity through which the sound generated by the vibrator passes;

a slit connected to an end portion of the path, the slit configured to emit the sound generated by the vibrtator; and a surface reflecting plate coupled to the cavity, the surface reflecting plate configured to form a bottom boundary of the slit and configured to reflect the sound emitted through the slit.

2. The sound generating apparatus as claimed in claim 1, wherein the vibrator includes a mid-range sound generator and a high-range sound generator, and the mid-range sound generator includes at least one of a rectangular speaker or an elliptical speaker.

3. The sound generating apparatus as claimed in claim 2, wherein the high-range sound generator is a tweeter.

4. The sound generating apparatus as claimed in claim 1, wherein a shape of the body part is a rectangular shape or an elliptical shape.

5. The sound generating apparatus as claimed in claim 1, wherein the body part is formed so that an area of the slit is maximized and a volume of the path is minimized under a condition in which an intensity of the sound generated in the vibrator is constant.

6. The sound generating apparatus as claimed in claim 5, wherein the volume of the path and the area of the slit are modeled based on a Helmholtz resonator.

7. The sound generating apparatus as claimed in claim 1, wherein the vibrator is formed in one side of the path, and an end portion of the vibrator is formed to protrude outward from the path.

8. The sound generating apparatus as claimed in claim 1, wherein the path is formed to have a predetermined slope with respect to the body part.

9. The sound generating apparatus as claimed in claim 1, wherein an orientation of the vibrator is divergent from an orientation of the body part.

10. An electronic apparatus comprising the sound generating apparatus according to claim 1.

11. The sound generating apparatus as claimed in claim 1, wherein an orientation of the vibrator is at a substantially right angle to an orientation of the body part.

12. The sound generating apparatus as claimed in claim 1, wherein the vibrator comprises a plurality of vibrators, and the plurality of vibrators are disposed in parallel in the body part.

13. A slit-type speaker comprising:

a vibrator configured to generate sound; and a body comprising:

a recess, the vibrator disposed in the recess;

a slit through which the sound generated by the vibrator is emitted from the body; and a surface reflecting plate coupled to the recess, the surface reflecting plate configured form a bottom boundary of the slit and configured to reflect the sound emitted through the slit, wherein an area of the slit is maximized, and a volume of the recess excluding the portion of the recess in which the vibrator is disposed is minimized, under a condition in which an intensity of the sound generated by the vibrator is constant.

14. The slit-type speaker as claimed in claim 13, wherein an orientation of the recess relative to a surface of the body is substantially orthogonal to an orientation of the slit relative to the surface of the body.

15. The slit-type speaker as claimed in claim 14, wherein an orientation of the vibrator is substantially parallel to the orientation of the recess.

16. The slit-type speaker as claimed in claim 15, wherein a first portion of the vibrator is exposed to the slit and a second portion of the vibrator faces a reflection surface of the recess.

17. The slit type-speaker as claimed in claim 13, wherein an orientation of the recess relative to a surface of the body is acutely divergent to an orientation of the slit relative to the surface of the body.

18. The slit-type speaker as claimed in claim 17, wherein an orientation of the vibrator is substantially parallel to the orientation of the recess.

19. The slit-type speaker as claimed in claim 18, wherein a first portion of the vibrator is exposed to the slit and a second portion of the vibrator faces a reflection surface of the recess.

* * * * *